US005744269A

United States Patent [19]

Bhattacharya et al.

[11] Patent Number: 5,744,269

[45] Date of Patent: Apr. 28, 1998

[54] METHOD FOR PROTECTING DEVELOPED ELECTROSTATIC IMAGES USING AN AMPHIPATHIC TONER

[75] Inventors: Romit Bhattacharya, Morris Plains; Giovanni Perrotta, Wayne; Achyut Bhalchandra Deshpande, South Orange; Paul Rocco Bilancio, Oak Ridge, all of N.J.

[73] Assignee: Specialty Toner Corporation, Fairfield, N.J.

[21] Appl. No.: 774,324

[22] Filed: Nov. 25, 1996

[51] Int. Cl.[6] ..... G03G 13/20; G03G 3/00

[52] U.S. Cl. ..... 430/18; 430/33; 430/124

[58] Field of Search ..... 430/18, 33, 124

[56] References Cited

U.S. PATENT DOCUMENTS

| | | | |
|---|---|---|---|
| 3,669,859 | 6/1972 | Merrill | 430/124 |
| 3,669,886 | 6/1972 | Kosel . | |
| 3,753,760 | 8/1973 | Kosel . | |
| 3,820,987 | 6/1974 | Wells et al. | 430/33 |
| 3,861,911 | 1/1975 | Luebbe | 430/124 |
| 3,900,412 | 8/1975 | Kosel . | |
| 3,953,206 | 4/1976 | Weigl . | |
| 3,990,980 | 11/1976 | Kosel . | |
| 3,991,226 | 11/1976 | Kosel . | |
| 4,259,429 | 3/1981 | Gilliams et al. | 430/124 |
| 4,264,185 | 4/1981 | Ohta . | |
| 4,818,657 | 4/1989 | Kondo et al. | 430/114 |
| 5,232,812 | 8/1993 | Morrison et al. | 430/124 |

FOREIGN PATENT DOCUMENTS

| | | | |
|---|---|---|---|
| 257190 | 5/1963 | Australia | 430/124 |

OTHER PUBLICATIONS

S.P. Schmidt, J.R. Larson and R. Bhattacharya, Liquid Toner Technology, Handbook of Imaging Materials, 1990, 227–252.

*Primary Examiner*—Roland Martin

*Attorney, Agent, or Firm*—Pennie & Edmonds LLP

[57] ABSTRACT

A method of protecting an electrostatic image on a substrate, wherein, an electrostatic image is formed on the substrate, and protected by applying an amphipathic liquid toner on the electrostatic image by electrostatic means, and fixing the amphipathic liquid toner to form a protective layer. The amphipathic liquid toner includes a carrier fluid, an amphipathic, non-gel copolymer, and a charge control agent to provide an electrostatic charge. The carrier fluid is typically an electrically resistive hydrocarbon solvent, having an electrical resistivity of at least about $10^9$ ohm•cm, a dielectric constant of less than about 3, and a boiling point from about 68° C. to about 250° C. The amphipathic, non-gel copolymer, which is insoluble as a whole in the carrier fluid, has at least one polymer segment that is soluble in the carrier fluid and at least one polymer segment that is insoluble in the carrier fluid. The soluble polymer segment includes at least one monomer of an alkyl acrylate or alkyl methacrylate and, optionally, at least one vinyl aromatic monomer. The insoluble polymer segment includes at least one vinyl ester monomer or at least one vinyl ester monomer and at least one acrylic acid or methacrylic acid monomer.

24 Claims, 1 Drawing Sheet

METHOD FOR PROTECTING DEVELOPED ELECTROSTATIC IMAGES USING AN AMPHIPATHIC TONER

The invention relates to a method of protecting an image, typically an electrostatic print, with an amphipathic toner that is applied to the image with an electrostatic charge in the same manner as used to produce the image. The amphipathic toner provides images with protection from fading on exposure to light and resistance to scratching and weather. Images protected or produced with the method of the invention can thus be used in situations where they will be exposed to bright light or weather without the use of prior art protective laminates.

BACKGROUND OF THE INVENTION

Use of liquid toners for electrostatography, i.e., the production of a visible, permanent image from a latent image consisting of a pattern of electrostatic charges, is well known. Liquid toners are typically used to develop electrostatic images in imaging systems that incorporate features similar to those of dry toner based copier and printer systems. However, liquid toner particles are significantly smaller than dry toner particles, i.e., typically less than about 3 μm, and are capable of producing toned images having very high resolution. Therefore, liquid toners have a number of advantages over dry toners, including the production of sharper and better defined images, a higher degree of and more delicate gradations of contrast, and cleaner whites. Liquid toners can also provide for a more economical use of the toner, a faster developing cycle, and simpler, less expensive and more trouble-free developing equipment.

Liquid toners are generally used to produce an image by the selective deposition of a pigment on a substrate to form a visible pattern. Although liquid toners are typically used in liquid electrostatic developers for electrostatic printers and copiers, they can also be used in ink-jet printers, as well as equipment for high-speed print-outs and reproductions of microfilms, facsimile printing, and instrument recordings. Images produced with liquid toners include pictures, including half-tone pictures, line pictures, and photographic reproductions, as well as symbols, digits, graphs, and letters, i.e., any image that can be produced on an analog or digital electrostatic copier or printer. In particular, liquid toners are increasingly used to produce signs, posters, and charts for seminars and corporate events and meetings, binder cover inserts, packaging, short-run labels, store window display graphics, and outdoor billboards.

Typically, liquid toners have two phases, a continuous phase of a liquid hydrocarbon solvent system and a dispersed phase of dispersed pigments. The liquid hydrocarbon system has a high electrical resistivity, i.e., greater than $10^9$ ohm•cm. This high resistivity does not allow the electrostatic charges on the substrate, typically a copy sheet or an electrostatic or xeroprinting master, to bleed off before the image is formed, thus maintaining the desired degree of contrast.

The liquid hydrocarbons should evaporate quickly, so that a thin film will evaporate in a few seconds at a temperature below the char point of paper, and should dry fully, so that a liquid-free pigment film is deposited. The liquid hydrocarbon system should be nontoxic when the vapor is inhaled or when the liquid comes in contact with skin, substantially odor free, and physically and chemically inert with respect to the copy sheet. A low viscosity is desirable, since this allows the dispersed phase to migrate through the continuous phase as a result of an attraction to an electrostatically charged substrate, to form an image by coupling with a pattern of electrostatic charges on the substrate.

The continuous phase contains dissolved and suspended solids, including pigments, a fixative or fixing agent, typically a thermoplastic resin having the ability to flow under heat to fuse the deposited material to the substrate surface, and increase the bond between the deposited material and the substrate. Dissolved and suspended solids also include a dispersant, typically a long chain organic compound, such as a synthetic polymer, having both oil soluble and polar groups, to aid in the dispersion of suspended particles, and a charge director, typically a metallic derivative of a fatty acid or resin acid. The charge director is absorbed by individual pigment particles, which causes the pigment particles to aggregate in the dispersed phase. The dispersion of the aggregates formed is stabilized by the dispersant by an entropic repulsion mechanism.

The charge director also acts as an ionic surfactant, which forms inverse micelles in low dielectric media, such as the liquid hydrocarbon solvent system, and produces an electrostatic charge on particles dispersed in the continuous phase. Although a number of mechanisms are believed to be involved in the spontaneous separation of charges between the dispersed particles and the micelles, the acid-base chemistry of the dispersed particles and the ionic surfactant micelles is believed to play a major role in the production of charged particles, so that a proton or cation exchange from the particles to the micelles occurs when negatively charged particles are produced, and from the micelles to the particles when positively charged particles are produced. In addition, an electrode may be used to induce an electrostatic charge in the toner particles prior to their application to a substrate. The charge on the particles can be selected by the appropriate choice of charge director.

U.S. Pat. Nos. 3,753,760, 3,900,412, 3,990,980, and 3,991,226 to Kosel disclose a type of liquid toner that reduces the number of different types of solid materials dissolved or suspended in the hydrocarbon solvent system, and may be used alone or in combination with a conventional toner as described above. The disclosed liquid toner comprises a solvent system, such as the one described above, and a complex amphipathic polymer, a polymer in which at least one part of the molecule is solvated by the continuous phase and at least one part is insoluble in the continuous phase. The complex amphipathic polymer includes at least two different polymeric moieties that act as a fixer and a dispersant, and may also include an additional moiety that provides color to the toner. As a result, the amphipathic polymer combines the fixing agent, the dispersing agent, and, optionally, the color agent in one complex molecule. This type of liquid toner is essentially a colloidal suspension, and may be referred to as a latex toner.

Electrographic and electrophotographic processes are well known, and are described by Steven P. Schmidt et al., *Handbook of Imaging Materials,* Chap. 6, 227–252 (1991). There are the numerous variations of these processes, all of which incorporate the same basic steps of creating an electrostatic image on a substrate, developing the image with charged, colored particles, i.e., toner, optionally transferring the resulting developed image to a secondary substrate, and fixing the image to the substrate.

The first basic step, the creation of an electrostatic image, can be accomplished by a variety of methods. In the electrophotographic process, the electrostatic image is formed by a discharge of a uniformly charged photoconductor. The discharge occurs when the uniformly charged photoconductor is exposed to light, which may be reflected from or transmitted through an image that is being copied, or be provided by a laser in a digital laser copier or printer. The exposure may be analog or digital, and the photoconductor may be single use or rechargeable and reimageable. Single use devices may be repeatedly charged and developed after a single exposure, but are permanently imaged by the exposure. With both the single use and rechargeable devices, the electrostatic image is created by corona charging a photoconductor, followed by image wise exposure and photodischarge. The electrostatic image is then developed with liquid toner having either positively or negatively charged particles, and transferred electrostatically to plain paper. The photoconductor may then be cleaned, charged, and reimaged.

In one form of the electrostatic process, a photosensitive element is permanently imaged to form areas of differential conductivity. The electrostatic image is created by uniform electrostatic charging followed by differential discharge of the imaged element. The electrographic or xeroprinting elements or masters can be repeatedly charged and developed after a single imaging exposure.

In an alternative electrographic process, electrostatic images are created ionographically. The latent image is created on a dielectric medium, such as paper or film, which is capable of holding a charge, by applying a voltage to one or more members of an array of electronic writing styluses or nibs. The styluses or nibs are selected in a manner that will produce the desired image when ions are produced from the applied voltage, placing a charge, and forming the latent image on the dielectric medium.

However the electrostatic image is produced, the image is developed with toner particles that possess a charge opposite to that of the charged surface to which they are applied. With liquid toners, a flowing liquid ensures the availability of sufficient toner particles to develop the image. When the flowing liquid is brought into direct contact with the electrostatic image, the charge of the electrostatic image creates a field that causes the charged toner particles to move through the nonconductive continuous phase by electrophoresis. As the charged toner particles contact the latent electrostatic image, the charge of the image is neutralized by the oppositely charged toner particles, and a layer of pigment is deposited, forming a permanent image.

If a reimageable photoreceptor or an electrographic master is used, the developed image must be transferred to paper or other substrate. To transfer the image, the substrate is charged electrostatically with the polarity chosen to cause the toner particles to transfer to the substrate. The substrate is then brought in contact with the reimageable photoreceptor or an electrographic master to produce the final image on the desired substrate.

Finally, the toned image must be fixed to the substrate. For self-fixing toners, residual solvent is removed from the substrate by air-drying or heating. The evaporation of the solvent results in a toner film that is bonded to the paper. For heat fusible toners, thermoplastic polymers are incorporated in the toner particles. Heating removes any residual solvent and fixes the toner to the substrate.

For color images, four different liquid toners having different colored pigments are used individually in four separate passes through the developer. Color printers typically have four separate sources of toner, which are typically referred to as toner fountains, one for each of the colored toners, i.e., one for black and one for each of the primary colors used in color developing: magenta, cyan, and yellow. However, there are commercially available printers that include a fifth fountain for an additional toner. On each pass of the substrate through the developer, the latent image is formed in a manner such that only that part of the image that is of a particular color is deposited on any given pass. After the fourth pass, the four toners form a full color image.

Where the fully developed image is a poster, sign, window display, billboard, or other image that will be exposed to bright light and/or weather, the image must be protected from fading, scratching, and weathering. This is typically accomplished by applying a layer of a clear plastic laminate over the surface of the image. However, this process is costly and labor intensive, because the image must first be removed from the printer or copier on which it is produced, and then transported to a second device that applies the laminate. Typically, this process involves passing the image and a thin layer of plastic between a pair of heated rollers, which press the laminate onto the surface of the image. This bonds the laminate to the surface of the image to form a protective layer. However, under some circumstances the laminate can delaminate and separate from the surface of the image.

Therefore, there is a need for a method of protecting developed electrostatic images that does not involve the prior art lamination process. The present invention provides such a method.

SUMMARY OF THE INVENTION

The present invention relates to a method for protecting electrostatic images on a substrate, which comprises electrostatically applying an amphipathic liquid toner over an electrostatic image on a substrate, and fixing the amphipathic liquid toner to form a protective layer on the electrostatic image on the substrate. The amphipathic liquid toner comprises an electrically resistive hydrocarbon solvent as a carrier fluid, having an electrical resistivity of at least about $10^9$ ohm•cm, a dielectric constant of less than about 3, and a boiling point from about 68° C. to about 250° C., an amphipathic, non-gel copolymer, which is insoluble as a whole in the carrier fluid, and a charge control agent to provide an electrostatic charge. The amphipathic, non-gel copolymer has at least one polymer segment that is soluble in the carrier fluid and at least one polymer segment that is insoluble in the carrier fluid. The soluble polymer segment comprises at least one alkyl acrylate or alkyl methacrylate monomer or at least one alkyl acrylate or alkyl methacrylate monomer and at least one vinyl aromatic monomer. The insoluble polymer segment comprises at least one vinyl ester monomer or at least one vinyl ester monomer and at least one acrylic acid or methacrylic acid monomer.

Typically, the alkyl group in the soluble polymer segment contains from about 3 to about 20 carbon atoms, and the insoluble polymer segment is a homopolymer of vinyl acetate or a copolymer of vinyl acetate and an alkyl acrylate or alkyl methacrylate having up to about 20 carbon atoms. When present, the vinyl aromatic monomer typically contains a six member aromatic ring, and has a total of from about 6 to about 10 carbon atoms. Preferably, the vinyl aromatic monomer is vinyl toluene or styrene.

Preferably, the soluble polymer segment comprises butyl, isobutyl, tertiarybutyl, 2-ethylhexyl, octyl, isononyl, decyl, lauryl, dodecyl, or stearyl acrylate or methacrylate monomers, and the insoluble segment is a homopolymer of vinyl acetate or a copolymer of vinyl acetate and lauryl methacrylate, stearylmethacrylate, n-butyl methacrylate, acrylic acid, or methacrylic acid. The preferred charge control agent is a metallic salt of naphthenic, octylic, or stearic acid, incorporating Li, Ca, Ba, Zr, Mn, Co, Ni, Cu, Zn, Cd, Al or Pt.

Preferred amphipathic, non-gel copolymers include copolymers of from about 10 to about 40 parts lauryl methacrylate and from about 100 to about 200 parts vinyl acetate; copolymers of from about 10 to about 50 parts stearyl methacrylate and from about 100 to about 200 parts vinyl acetate; copolymers of from about 5 to about 45 parts 2-ethyl hexylacrylate and from about 100 to about 200 parts vinyl acetate; copolymers of from about 200 to about 275 parts of a vinyl acrylic resin containing a vinyl aromatic compound, from about 2 to about 5 parts lauryl methacrylate, from about 5 to about 10 parts n-butyl methacrylate, from about 10 to about 20 parts methacrylic acid, and from about 10 to about 20 parts vinyl acetate; and copolymers of from about 50 to about 75 parts of a vinyl acrylic resin containing a vinyl aromatic compound, from about 50 to about 75 parts lauryl methacrylate, from about 50 to about 75 parts vinyl acetate, and from about 1 to about 5 parts methacrylic acid.

The protective layer may be formed and applied in the method of the invention in a single step. In the alternative, the electrostatic image may be formed on a first substrate, while the protective layer is formed on a second substrate. The protective layer is then transferred from the second substrate to the electrostatic image on the first substrate to form the protective layer. In either case, an electrostatic charge is formed over at least a part of the electrostatic image, and the charged part of the electrostatic image is contacted with the amphipathic liquid toner, such that the amphipathic polymers move through the carrier fluid by electrophoresis, and adhere to the charged part of the electrostatic image to form the protective layer.

The present invention also relates to an electrostatic image on a substrate, which is resistant to fading from exposure to light, scratching, and weathering. The electrostatic image comprises a protective layer covering the electrostatic image on the substrate, where the protective layer includes an amphipathic liquid toner comprising an amphipathic, non-gel copolymer, as described above.

DETAILED DESCRIPTION OF THE INVENTION

Figure 1:
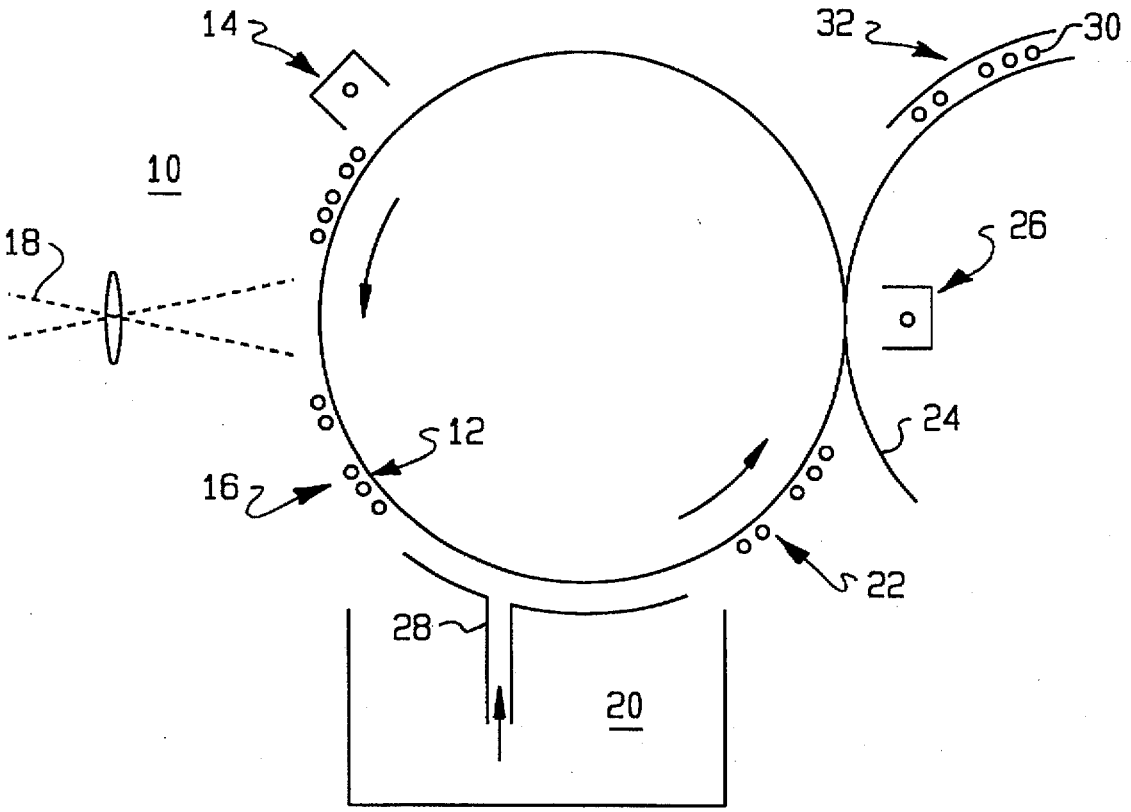
FIG. 1 illustrates the application of a protective layer by the method of the invention, using an electrophotographic printer.

As used herein, the terms "electrostatic image" and "electrostatic print" refer to any image, picture, half-tone picture, line picture, photographic reproduction, symbol, digit, graph, letter, sign, poster, chart, binder cover insert, packaging, short-run label, store window display graphic, outdoor billboard, or any other type of image produced with any electrostatic method, including electrostatography, electrostatic developers, xeroprinting, xerography, and any other electrographic or electrophotographic method.

The present invention is directed to a method of protecting an electrostatic image by applying an amphipathic toner to the surface of the electrostatic image, using the same electrostatic method that was used to form the electrostatic image. Amphipathic toners contain amphipathic polymeric materials that can be given a positive or negative charge, so that they can be applied to the electrostatic image using an electrostatic charge. Amphipathic toners compositions can be clear or colorless or can be tinted with dyes, pigments, fluorescent pigments, or with other materials that provide additional properties when exposed to ultraviolet (UV) light. When applied to an electrostatic print with the method of the invention, amphipathic toners replace the plastic laminates typically used to provide protection from fading and resistance to scratching and weather, so that the image can be used for outdoor billboards or other any other purpose where the image will be exposed to UV light or weather.

Amphipathic toners useful in the invention comprise a dispersion of an amphipathic, non-gel copolymer and a charge control agent in a continuous phase of an electrically resistive dispersion medium or carrier fluid, typically an aliphatic hydrocarbon solvent. The amphipathic, non-gel copolymer, which is insoluble as a whole in the continuous phase, comprises a homopolymer or copolymer segment that is soluble in the solvent and a homopolymer or copolymer segment that is insoluble in the solvent. The solvent soluble polymer segment comprises as the main monomer component at least one alkyl acrylate methacrylate monomer or at least one alkyl acrylate or methacrylic acid and, optionally, at least one vinyl aromatic monomer, i.e., an aromatic compound containing at least one vinyl group. The solvent insoluble polymer segment comprises a vinyl ester monomer or a vinyl ester monomer with methacrylate acid or acrylic acid as the main monomeric component.

The charge control agent in added to impart a charge to the gel-polymer, and enhances the electrostatic charge conductance of the copolymer, which aids the dispersion stability of the copolymer. The higher dispersion stability is a necessary condition for the further application of the copolymer.

The charge control agent must be capable of improving the dispersion stability of the copolymer. Preferred charge control agents include metallic salts of naphthenic, octylic, and stearic acids. Metallic salts incorporating metals such as Li, Ca, Ba, Zr, Mn, Co, Ni, Cu, Zn, Cd, Al and Pt are useful as charge control agents. Group II and IV metals of the Periodic Table as well as transition metals are preferred, and aluminum salts are most preferred. Charge control agents useful in the method of the invention include, but are not limited to ionic surfactants, metal soaps, alkylated aryl sulfonates, alkylated aryl sulfonates with excess calcium or barium carbonate, such as basic barium petronate, neutral barium petronate, calcium petronate, neutral barium dinonylnaphthalene sulfonate, basic barium dinonylnaphthalene sulfonate, neutral calcium dinonylnaphthalene sulfonate, basic calcium dinonylnaphthalene sulfonate, dodecyl benzene sulfonic acid sodium salt, polyisobutylene succinimides, soy lecithin, N-vinyl pyrolidone polymers, sodium salts of phosphated mono- and diglycerides with saturated and unsaturated acid substituents, polymers AB diblock copolymers of 2-(N,N)dimethylaminoethyl methacrylate quarternized with methyl-p-toluenesulfonate, AB diblock copolymers of poly-2-ethylhexyl methacrylate, and divalent and trivalent metal carboxylates, such as aluminum tristearate, barium stearate, chromium stearate, magnesium octoate, calcium stearate, iron naphthenate, and zinc naphthenate.

Any electrically resistive aliphatic hydrocarbon having an electrical resistivity of at least about $10^9$ ohm•cm, a dielectric constant no more than about 3, and a boiling point of from about 68° C. to about 250° C. may be utilized as the dispersion medium or carrier fluid that functions as the continuous phase. Electrically resistive aliphatic hydrocarbons useful in the invention include, but are not limited to hexane, octane, nonane, decane, undecane, and dodecane, as well as commercially available solvents such as ISOPAR® G, H, L, and M, produced by Exxon Chemical, Inc., which are mixtures of isoparaffinic hydrocarbons, having boiling points of from about 150° C. to 200° C. Preferred solvents include ISOPAR G®, which has a boiling point range of about 155° to 176° C., a flash point of about 40° C., and $C_{10}$ and $C_{11}$ hydrocarbons as the predominant molecular constituents, and ISOPAR H®, which has a boiling point range of about 169° to 193° C., a flash point of about 49° C., and $C_{11}$ and $C_{12}$ hydrocarbons as the predominant molecular constituents.

The soluble polymer segment of the amphipathic, non-gel copolymer stabilizes the dispersion. Preferably, the soluble polymer segment comprises alkyl acrylate or methacrylate monomers or alkyl acrylate or methacrylate and vinyl aromatic monomers. The alkyl acrylate or methacrylate typically has 3 to 20, preferably 4 to 18 carbon atoms. Useful alkyl acrylates and methacrylate include, but are not limited to butyl, isobutyl, tertiarybutyl, 2-ethylhexyl, octyl, isononyl, decyl, lauryl, dodecyl, and stearyl acrylates and methacrylates. The vinyl aromatic compound typically includes a six member aromatic ring, and has 6 to 10 carbon atoms. Preferred, vinyl aromatics include vinyl toluene and styrene.

In general, the polymerization product of an alkyl acrylate or methacrylate has a relatively low glass transition point, and the polymerization product of a vinyl aromatic has a relatively high glass transition point. Accordingly, a copolymer comprising at least one alkyl acrylate or alkyl methacrylate monomer and at least one vinyl aromatic monomer, such as the soluble polymer segment of the amphipathic, non-gel copolymers useful in the present invention, will have an intermediate glass transition point and a hardness that falls between that of a poly-alkyl acrylate or methacrylate and that of a poly-vinyl aromatic.

The insoluble polymer segment of amphipathic, non-gel copolymers useful in the present invention is a polymer segment containing vinyl acetate as a main component. The insoluble polymer segment may be a homopolymer of vinyl acetate or a copolymer of vinyl acetate and one or more other vinyl monomers, including lauryl methacrylate, stearyl methacrylate, n-butyl methacrylate, acrylic acid, and methacrylic acid. The vinyl acetate content of the insoluble polymer segment is typically 1 to 90 percent by weight, preferably 3 to 85 percent by weight.

Typically, the alkyl methacrylate and acrylates contain 1 to 20 carbon atoms, preferably 1 to 18 carbon atoms. Preferred alkyl methacrylates include n-butyl methacrylate and lauryl methacrylate. The preferred acid is methacrylic acid.

Diacyl peroxides are typically employed as polymerization catalysts to form the amphipathic, non-gel polymers that are useful in the method of the invention. Preferred catalysts include benzoyl peroxide, lauryl peroxide and p-chlorobenzoyl peroxide.

The copolymer aliphatic hydrocarbon solvent used as the continuous phase may also be used as a reaction solvent in the preparation of the amphipathic, non-gel copolymer in a one stage process in which both the soluble and insoluble segments of the final insoluble polymer are added into the reaction solvent at room temperature, and polymerization is allowed to take place at elevated temperature. Following polymerization, the amphipathic toner is ready for use in the method of the invention without any further processing steps.

The molecular weight of the amphipathic, non-gel copolymers used in the final product differ depending on the kind and combination of monomers used, but preferably the molecular weight ranges from about 5,000 to about 50,000, more preferably from about 8,000 to about 20,000.

The ratio of the amount of soluble polymer segment to that of the insoluble polymer segment differs depending on the combination of monomers used. Because there is substantially complete conversion of the monomers into polymer, the weight ratio of the soluble polymer and insoluble polymer segments is the same as that of the weight ratio of the monomers that make up each segment. Typically, the copolymer comprises from about 5 to about 95 percent of the soluble polymer segment, based on the total weight of copolymer used in the final product, preferably about 10 to about 90 weight percent, more preferably from about 14 to about 85 weight percent. Copolymers having amounts of insoluble polymer segment outside the preferred range produce particles that are larger than those desired for the method of the invention. Larger particles tend to agglomerate and separate from the hydrocarbon solvent to form a sticky lump. For copolymers having amounts of insoluble polymer segment within the preferred range, the particle size of the insoluble polymer segment is smaller, which improves the further application of the protective coating. The preferred particle size ranges from about 0.1 μm to about 0.5 μm.

As long as the amphipathic, non-gel copolymer contains both the soluble polymer segment and the insoluble polymer segment, the method of bonding those segments is not critical. However, a graft copolymer comprising the soluble polymer segment with the insoluble polymer segment is preferred.

The amphipathic toner described above and exemplified below can be applied to an electrostatic image to form a protective layer. Typically, the image is formed, and the protective layer is applied using an electrostatic method, such as those described above and illustrated in FIGS. 1 and 2. FIG. 1 illustrates electrophotographic device 10 in which photoconductor 12 is uniformly charged by charging source 14. An electrostatic image 16 is formed by an analog or digital imagwise photodischarge of charge photoconductor 12. In an analog discharge, the light 18 used to cause the photodischarge is typically reflected from or transmitted through an image being copied. For a digital discharge, the light source is typically a laser, which may be used to digitally scan an image to produce a copy, or may be controlled by a computer to produce a computer created digital image. In either case, the electrostatic image 16 is developed by contacting the image 16 with liquid toner 20 from toner fountain 28, containing a pigment, which is typically black, magenta, cyan, or yellow for color prints. The toned image 22 is then transferred to a substrate 24, such as paper or film, by applying a charge to the substrate from charging source 26. The toned image is attracted to the charge on substrate 24, and forms a final electrostatic image 30. For a full color image, four passes through the electrostatic device 10 are required. On each pass only that part of the image that corresponds to a specific color, i.e., black, magenta, cyan, or yellow, is formed. The image is developed with the appropriately colored toner 20 and transferred to substrate 24. In the method of the invention, electrophotographic device 10 typically has a fifth toner fountain 28 for the amphipathic toner 20. The amphipathic toner 20, as described above, is typically clear or colorless, but can be tinted with dyes, pigments, fluorescent pigments, or with other materials that provide additional properties when exposed to ultraviolet (UV) light. The amphipathic toner 20 is applied by uniformly charging the photoconductor 12, and contacting the charged photoconductor 12 with the amphipathic toner 20 without discharging the photoconductor 12. This produces a toned image 16 that comprises a single, uniform layer of amphipathic toner, which is then transferred onto the surface of the image 30 on the substrate 24. This results in an image 30, resistant to fading, scratching, and weathering, comprising an image 30 on a substrate 24 and a protective layer 32 of amphipathic toner.

Figure 2:
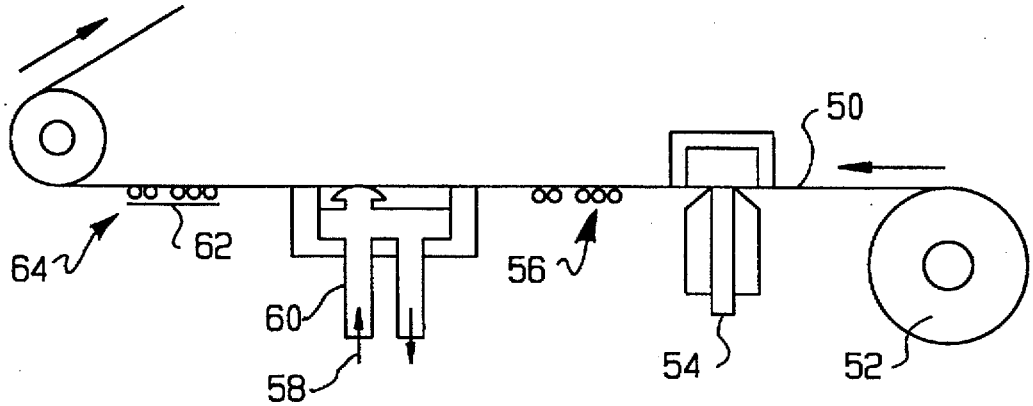
FIG. 2 illustrates the application of a protective layer by the method of the invention ionographically.

FIG. 2 illustrates an alternative electrographic process, in which an electrostatic image is produced ionographically on a dielectric substrate, e.g., paper or film. Dielectric substrate 50 from dielectric substrate source 52 receives an electrostatic charge from an array of electrostatic writing style or nibs 54, creating electrostatic image 56. As in FIG. 1, the electrostatic image is developed by contact with a liquid toner 58 of the appropriate color from fountain 60 to form a toned image 62. The protective layer is then applied by charging the image over at least the entire area of the toned image 62, and contacting the charged image with the amphipathic toner. The toned image 62 is then fixed to the paper by heat, which evaporates residual carrier fluid, and forming a fixed layer 64 of amphipathic polymer on the toned image 62.

Figure 3:
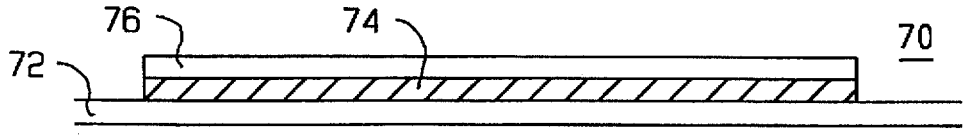
FIG. 3 illustrates a cross section of an electrostatic image, protected with the method of the invention.

FIG. 3 illustrates a cross-section of an electrostatic image on a substrate, protected with the method of the invention. The protected electrostatic image 70 comprises a substrate 72, such as paper or film, a layer of toner particles 74, which are fixed to the substrate 72, and form the electrostatic image, and a layer of amphipathic toner 76, which forms a protective layer over the electrostatic image, and provides protection from light, scratching, and weathering.

The following non-limiting examples are merely illustrative of the preferred embodiments of the present invention, and are not to be construed as limiting the invention, the scope of which is defined by the appended claims. In particular, the following examples illustrate methods of producing the amphipathic, non-gel copolymer for use in the method of the invention. All references to "part" and "parts" are parts by weight.

EXAMPLE 1

Three hundred thirty five parts ISOPAR G were mixed with 140 parts vinyl acetate and 25 parts lauryl methacrylate. After adding 0.7 percent benzoyl peroxide, based on the weight of the monomer mixture, the reaction was heated and stirred. Refluxing of the reaction mixture began at around 90° C. After about two hours, the refluxing reaction mixture became milky white, as an emulsion formed, and, due to the exotherm of the reaction, the temperature increased rapidly to 130° C., where it was maintained for approximately 24 hours. One part charge control agent (aluminum stearate) and 0.1 part UV resistant agent (Tinuvin 130) were then added. After about an hour, the heating source was disconnected, the reaction product was allowed to cool, and a white emulsion having a non-volatile matter content of 30 wt percent was obtained. The emulsion can be used in the method of the invention as an amphipathic toner without further processing steps.

EXAMPLE 2

The procedure in accordance with Example 1 was followed, except that 25 parts lauryl methacrylate was replaced by 25 parts stearyl methacrylate monomer as the soluble polymer segment. The reaction mixture was refluxed for about one hour, and, on cooling, a white emulsion having extremely superior dispersion stability and a non-volatile content of 30 wt percent was obtained. The emulsion can be used in the method of the invention as an amphipathic toner without further processing steps.

EXAMPLE 3

The procedure in accordance with Example 1 was followed, except that 25 parts lauryl methacrylate was replaced by 25 parts 2-ethyl hexylacrylate monomer as the soluble polymer segment. On cooling, a white emulsion having superior dispersion stability and a non-volatile matter content of 30 wt percent was obtained. The emulsion can be used in the method of the invention as an amphipathic toner without further processing steps.

EXAMPLE 4

Two hundred and thirty one ISOPAR G was mixed with 258 parts vinyl aromatic containing vinyl acrylic resin. Ten parts vinyl acetate, 5 parts lauryl methacrylate, and 6 parts methacrylic acid were then added, and the reaction mixture was stirred at room temperature. Following the addition of 3.4 percent of benzoyl peroxide the reaction mixture was heated and stirred. After about two hours, the temperature of the reaction mixture reached about 90° C., at which point a milky white emulsion began to form. Due to the exotherm of the reaction, the temperature of the mixture eventually rose to about 120° C., where it was maintained for about 24 hours. The reaction mixture was then further charged with 8 parts n-butyl methacrylate and 1.0 percent benzoyl peroxide. After about 4 additional hours at high temperature, the milky copolymer product was mixed with 1 part aluminum stearate and 0.1 part Tinuvin 130, and allowed to cool after about 1 hour. A white emulsion having superior dispersion stability and a non-volatile matter content of 33 wt. percent was obtained. The emulsion can be used in the method of the invention as an amphipathic toner without further processing steps.

EXAMPLE 5

Two hundred ninety five parts ISOPAR G was mixed with 67 parts vinyl aromatic containing vinyl acrylic resin, 68 parts vinyl acetate, 68 parts lauryl methacrylate, and 3 parts methacrylic acid. The reaction mixture was stirred at room temperature, and 0.8 percent benzoyl peroxide monomer was added. The reaction mixture was stirred, and, after about 2 hours, the temperature increased to about 90° C., at which point a milky white emulsion began to form. Due to the exotherm of the reaction, the reaction temperature rose to about 120° C., where it was maintained for about 24 hours. The reaction mixture was then charged with additional 0.8 percent benzoyl peroxide monomer, and, after an additional 4 hours at about 120° C., 1 part aluminum stearate and 0.1 part Tinuvin 130 were added. After about another hour at that temperature, the heating was cut off and the reaction was allowed to cool to room temperature. A white emulsion having superior dispersion stability and a non-volatile matter content of 33 wt. percent was obtained. The emulsion can be used in the method of the invention as an amphipathic toner without further processing steps.

Any of the amphipathic toners exemplified above may be applied to an electrostatic image by any electrostatic means for producing an electrostatic image from a liquid toner known in the art to form a protective layer that protects the electrostatic imaging from fading due to exposure to light, as well as from scratching and weathering.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments as falling within the true spirit and scope of the present invention.

We claim:

1. A method for protecting developed electrostatic images on a substrate, which comprises:

electrostatically applying an amphipathic liquid toner over a developed electrostatic image on a substrate, said amphipathic liquid toner comprising:

a carrier fluid of an electrically resistive hydrocarbon solvent, having an electrical resistivity of at least about $10^9$ ohm•cm, a dielectric constant of less than about 3, and a boiling point from about 68° C. to about 250° C., an amphipathic, non-gel copolymer, which is insoluble as a whole in the carrier fluid, said amphipathic, non-gel copolymer having at least one polymer segment that is soluble in the carrier fluid and at least one polymer segment that is insoluble in the carrier fluid, wherein the soluble polymer segment comprises at least one alkyl acrylate or alkyl methacrylate monomer or at least one alkyl acrylate or alkyl methacrylate monomer and at least one vinyl aromatic monomer; and wherein the insoluble polymer segment comprises at least one vinyl ester monomer or at least one vinyl ester monomer and at least one acrylic acid or methacrylic acid monomer, and at least one charge control agent to provide an electrostatic charge; and fixing the amphipathic liquid toner, forming a protective layer on the developed electrostatic image on the substrate.

2. The method of claim 1, wherein the alkyl group in the soluble polymer segment contains from about 3 to about 20 carbon atoms, and the insoluble polymer segment is a homopolymer of vinyl acetate or a copolymer of vinyl acetate and an alkyl acrylate or alkyl methacrylate having up to about 20 carbon atoms.

3. The method of claim 2, wherein the soluble polymer segment comprises butyl, isobutyl, tertiarybutyl, 2-ethylhexyl, octyl, isononyl, decyl, lauryl, dodecyl, or stearyl acrylate or methacrylate monomers, and the insoluble segment is a homopolymer of vinyl acetate or a copolymer of vinyl acetate and lauryl methacrylate, stearylmethacrylate, n-butyl methacrylate, acrylic acid, or methacrylic acid.

4. The method of claim 2, wherein the soluble polymer segment comprises a vinyl aromatic monomer, which contains a six member aromatic ring, and has a total of from about 6 to about 10 carbon atoms.

5. The method of claim 4, wherein the vinyl aromatic monomer is vinyl toluene or styrene.

6. The method of claim 1, wherein the charge control agent is a metallic salt of naphthenic, octylic, or stearic acid, incorporating Li, Ca, Ba, Zr, Mn, Co, Ni, Cu, Zn, Cd, Al or Pt.

7. The method of claim 1, wherein the amphipathic, non-gel copolymer comprises from about 10 to about 40 parts lauryl methacrylate and from about 100 to about 200 parts vinyl acetate.

8. The method of claim 1, wherein the amphipathic, non-gel copolymer comprises from about 10 to about 50 parts stearyl methacrylate and from about 100 to about 200 parts vinyl acetate.

9. The method of claim 1, wherein the amphipathic, non-gel copolymer comprises from about 5 to about 45 parts 2-ethyl hexylacrylate and from about 100 to about 200 parts vinyl acetate.

10. The method of claim 1, wherein the amphipathic, non-gel copolymer comprises from about 200 to about 275 parts of a vinyl acrylic resin containing a vinyl aromatic compound, from about 2 to about 5 parts lauryl methacrylate, from about 5 to about 10 parts n-butyl methacrylate, from about 10 to about 20 parts methacrylic acid, and from about 10 to about 20 parts vinyl acetate.

11. The method of claim 1, wherein the amphipathic, non-gel copolymer comprises from about 50 to about 75 parts of a vinyl acrylic resin containing a vinyl aromatic compound, from about 50 to about 75 parts lauryl methacrylate, from about 50 to about 75 parts vinyl acetate, and from about 1 to about 5 parts methacrylic acid.

12. The method of claim 1, further comprising forming and applying the protective layer in a single step.

13. The method of claim 1, further comprising forming the developed electrostatic image on a first substrate, forming the protective layer on a second substrate, and transferring the protective layer from the second substrate to the developed electrostatic image on the first substrate.

14. The method of claim 1, further comprising producing an electrostatic charge over at least a part of the developed electrostatic image, and contacting the charged part of the developed electrostatic image with the amphipathic liquid toner, such that the amphipathic polymers move through the carrier fluid by electrophoresis, and adhere to the charged part of the developed electrostatic image to form the protective layer.

15. A developed electrostatic image on a substrate, produced according to the method of claim 1.

16. A developed electrostatic image on a substrate, said image having resistance to fading from exposure to light, scratching, and weathering, comprising:

a developed electrostatic image on a substrate and a protective layer covering the developed electrostatic image on the substrate, wherein the protective layer includes an amphipathic liquid toner comprising:

an amphipathic, non-gel copolymer, which is insoluble as a whole in a hydrocarbon solvent carrier fluid, having at least one polymer segment that is soluble in the carrier fluid and at least one polymer segment that is insoluble in the carrier fluid, wherein the soluble polymer segment comprises at least one alkyl acrylate or alkyl methacrylate monomer or at least one alkyl acrylate or alkyl methacrylate monomer and at least one vinyl aromatic monomer; and wherein the insoluble polymer segment comprises at least one vinyl ester monomer or at least one vinyl ester monomer and at least one acrylic acid or methacrylic acid monomer.

17. The developed electrostatic image of claim 16, wherein the alkyl group in the soluble polymer segment contains from about 3 to about 20 carbon atoms, and the insoluble polymer segment is a homopolymer of vinyl acetate or a copolymer of vinyl acetate and an alkyl acrylate or alkyl methacrylate having up to about 20 carbon atoms.

18. The developed electrostatic image of claim 17, wherein the soluble polymer segment is a copolymer of butyl, isobutyl, tertiarybutyl, 2-ethylhexyl, octyl, isononyl, decyl, lauryl, dodecyl, or stearyl acrylate or methacrylate and vinyl toluene or styrene, and the insoluble segment is a homopolymer of vinyl acetate or a copolymer of vinyl acetate and lauryl methacrylate, stearylmethacrylate, n-butyl methacrylate, acrylic acid, or methacrylic acid.

19. The developed electrostatic image of claim 17, wherein the soluble polymer segment further comprises vinyl toluene or styrene monomers.

20. The developed electrostatic image of claim 17, wherein the amphipathic, non-gel copolymer comprises from about 10 to about 40 parts lauryl methacrylate and from about 100 to about 200 parts vinyl acetate.

21. The developed electrostatic image of claim 17, wherein the amphipathic, non-gel copolymer comprises from about 10 to about 50 parts stearyl methacrylate and from about 100 to about 200 parts vinyl acetate.

22. The developed electrostatic image of claim 17, wherein the amphipathic, non-gel copolymer comprises from about 5 to about 45 parts 2-ethyl hexylacrylate and from about 100 to about 200 parts vinyl acetate.

23. The developed electrostatic image of claim 17, wherein the amphipathic, non-gel copolymer comprises from about 200 to about 275 parts of a vinyl acrylic resin containing a vinyl aromatic compound, from about 2 to about 5 parts lauryl methacrylate, from about 5 to about 10 parts n-butyl methacrylate, from about 10 to about 20 parts methacrylic acid, and from about 10 to about 20 parts vinyl acetate.

24. The developed electrostatic image of claim 17, wherein the amphipathic, non-gel copolymer comprises from about 50 to about 75 parts of a vinyl acrylic resin containing a vinyl aromatic compound, from about 50 to about 75 parts lauryl methacrylate, from about 50 to about 75 parts vinyl acetate, and from about 1 to about 5 parts methacrylic acid.

* * * * *